US009704677B2

(12) United States Patent
Amei

(10) Patent No.: US 9,704,677 B2
(45) Date of Patent: Jul. 11, 2017

(54) CONTACT CONTACTING STRUCTURE

(71) Applicant: SMK Corporation, Tokyo (JP)

(72) Inventor: Toshihiro Amei, Tokyo (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 14/968,899

(22) Filed: Dec. 15, 2015

(65) Prior Publication Data

US 2016/0379779 A1 Dec. 29, 2016

(30) Foreign Application Priority Data

Jun. 24, 2015 (JP) ..... 2015-126327

(51) Int. Cl.
*H01H 33/12* (2006.01)

(52) U.S. Cl.
CPC ..... *H01H 33/12* (2013.01)

(58) Field of Classification Search
CPC ..... H01H 33/06; H01H 33/12; H01H 33/187; H01B 3/00; H01R 13/03; H01R 13/53
USPC ..... 218/13, 14, 16, 37, 12, 41, 51, 53–57, 218/61–64
See application file for complete search history.

(56) References Cited

U.S. PATENT DOCUMENTS 4,052,555 A * 10/1977 Mears ..... H01H 33/22 174/17 GF
4,359,616 A * 11/1982 Ueda ..... H01H 33/901 218/57
4,958,052 A * 9/1990 Mahieu ..... H01H 33/7023 218/12
5,925,863 A * 7/1999 Zehnder ..... H01H 33/7023 218/53
7,566,842 B2 * 7/2009 Hunger ..... H01H 33/901 218/78
2003/0139518 A1 * 7/2003 Miyoshi ..... C08L 71/123 524/495
2004/0062287 A1 * 4/2004 Moriwaki ..... F27B 17/00 373/109
2010/0029110 A1 2/2010 Kiryu et al.

FOREIGN PATENT DOCUMENTS

JP S63-86281 A 4/1988
JP H4-2467 U 1/1992

* cited by examiner

*Primary Examiner* — Renee Luebke
*Assistant Examiner* — William Bolton

(57) ABSTRACT

Provided is a contact contacting structure that reliably prevents the development of arc discharge in a simple configuration regardless of the magnitude of electric energy accumulated between a pair of contacts that are connected and disconnected. An intermediate contact body disposed continuously with a first contact along a movement path of a second contact is formed from material with higher electric resistivity than the first contact in a shape such that the cross sectional area of a transverse section perpendicular to the movement path is gradually decreased in a separating direction along the movement path.

11 Claims, 6 Drawing Sheets

CONTACT CONTACTING STRUCTURE

CROSS REFERENCE TO RELATED APPLICATION

The contents of the following Japanese patent application are incorporated herein by reference, Japanese Patent Application NO. 2015-126327 filed on Jun. 24, 2015.

FIELD

The present invention relates to a contact contacting structure between a pair of contacts respectively for hot-line connection with electric circuits, and more particularly, to a contact contacting structure in which high electric energy is generated between a pair of contacts that are connected and disconnected.

BACKGROUND

An electric connector used for hot-line connection of electric power lines and the like for transmitting high voltage, high-current electric power may cause an arc discharge between a pair of contacts when the other connector to which the electric connector is connected is pulled, due to high electric energy that has been accumulated between the contacts contacting each other. Such arc discharge may also be caused by induced electromotive force produced when one connector connected to an inductive load is pulled out of the other connector connected to an electric power line.

Arc discharge is a cause of acceleration in degradation, such as erosion of the contacts of an electric connector. The problem has been addressed by largely two methods. The first method, as disclosed in JP-A-2010-56055 (Patent Literature 1), is aimed at preventing the damage to the contacts due to arc discharge by installing a permanent magnet and the like in a direction perpendicular to the opposed direction of a pair of contacts so as to apply a magnetic field and deflect the direction of arc by Lorentz force.

The second method is designed to prevent the development of arc discharge by decreasing the very electric energy accumulated between a pair of contacts. The electric energy stored between a pair of contacts is proportional to the voltage and current between the pair of contacts. Thus, in JP-A-63-86281 (Patent Literature 2) or JP-UM-4-2467 (Patent Literature 3), the voltage between a pair of contacts at the time of separation of the contacts is decreased to prevent the development of arc discharge.

Specifically, in a contact contacting structure 100 described in Patent Literature 2 as illustrated in FIG. 6, a contact 101 and a resistor 102 having a higher electric resistivity ρ than the contact 101 are disposed continuously along a movement path along which a contact 103 of the counterpart connector moves. When the other contact 103 is pulled along the movement path for separation, the contact 103 is separated at a distal end 102*a* of the resistor 102 where the resistance value is highest, so that the voltage therebetween does not reach an arc-discharge causing voltage, thereby preventing the development of arc discharge.

In a contact contacting structure 110 described in Patent Literature 3, as illustrated in FIGS. 7A and 7B, a contact 112 is provided with increasing resistance value in a separating direction (to the right in the figure) along the movement path of a counterpart contact 114. Thus, when the counterpart contact 114 is pulled along the movement path from its completely inserted state illustrated in FIG. 7A to the state of FIG. 7B, a distal end 112*a* portion of the contact 112 to which the contact 114 is proximate has the highest resistance, whereby a large potential drop is caused in the contact 112, preventing the development of an arc-discharge causing voltage between the distal end 112*a* and the contact 114.

SUMMARY

Technical Problem

In the first method according to Patent Literature 1, a magnetic field is generated by placing a permanent magnet and the like in a direction perpendicular to the opposed direction of a pair of contacts. Accordingly, the structure is complex and the size of the contact contacting structure is increased. In addition, the method does not prevent the development of arc discharge itself, so that an electromagnetic noise due to arc discharge may adversely affect an electronic circuit such as a load, thus failing to provide a fundamental solution.

In the contact contacting structure 100 according to the second method, when the other contact 103 is pulled, the contact 103 is separated from the contact 101 via the resistor 102 having high electric resistivity ρ, so that the voltage of the distal end 102*a* of the resistor 102 is dropped by the resistance value of the resistor 102. As illustrated in FIG. 8, since the resistance value of the resistor 102 is proportional to the distance from a position x0 of connection with the contact 101, the resistance value is at a maximum at a position x1 at the distal end 102*a* of the resistor 102. However, depending on the voltage applied between the contacts 101 and 103 or the current that flows between the contacts 101 and 103, a sufficient potential drop may not be caused by the resistor 102 even when the resistance value of the resistor 102 is maximized at the distal end 102*a* of the resistor 102, resulting in the development of arc discharge.

In this case, it may be feasible to form the resistor 102 from a conductive material with even higher electric resistivity ρ. However, when the resistor 102 of high resistance value is used, at the instant of the contact position of the contact 103 of the counterpart connector moving from the contact 101 to the resistor 102, arc discharge may be caused by the electric energy between the contacts 101 and 103 being proximate to each other, with the resistor 102 providing an insulator similar to air. Accordingly, the resistance value of the resistor 102 cannot be greatly increased before the contact position of the contact 103 reaches a predetermined distance from the connected position x0. Thus, a change in conductive material does not provide a solution.

The resistance value of the distal end 102*a* may be increased by extending the length of the resistor 102 between the connected position x0 and the distal end position x1. However, in this case, the resistance value would simply increase in proportion to the distance along the separating direction, and there is a limit to the upper limit of the resistance value of the resistor 102. In addition, extension in the separating direction results in an increase in the size of the contact contacting structure.

In the contact contacting structure 110 described in Patent Literature 3, the resistance value is increased as the contact 102 is moved in the separating direction (to the right in the figure) along the movement path. Because the electric resistivity ρ of the conductive material used for the contact 102 is an inherent value of the conductive material, in order to increase the resistance value per unit length with increasing distance in the separating direction (to the right in the figure), it is necessary to prepare multiple types of conductive material with gradually increasing electric resistivity ρ and to dispose the material in the separating direction continuously. This, however, is not practical.

The present invention was made in view of such problems, and an object of the present invention is to provide a contact contacting structure that reliably prevents the development of arc discharge in a simple structure regardless of the magnitude of electric energy accumulated between a pair of contacts that are connected and disconnected.

Solution to Problem

In order to achieve the object, a contact contacting structure according to a first aspect includes a first contact; a second contact; and an intermediate contact body electrically connected to the first contact, having a higher electric resistivity than the first contact, and continuously exposed along a movement path of the second contact for connection to or disconnection from the first contact. The second contact is configured to separate from the intermediate contact body after contacting the first contact and then the intermediate contact body when moved from the first contact in a separating direction along the movement path; and the intermediate contact body has a shape such that a cross sectional area of a transverse section perpendicular to the movement path gradually decreases in the separating direction at least in a section between a proximal end electrically connected to the first contact and a distal end in the separating direction.

The resistance value of the intermediate contact body from the proximal end electrically connected to the first contact and the contact position with the second contact is proportional to the distance from the proximal end to the contact position with the second contact along the movement path, and is inversely proportional to the cross sectional area of the transverse section of the intermediate contact body perpendicular to the movement path. Because the cross sectional area of the transverse section of the intermediate contact body is gradually decreased in the separating direction at least in a partial section, the resistance value of the intermediate contact body is more greatly increased than is proportional to the distance from the proximal end in that section.

Accordingly, the intermediate contact body has a low resistance when the contact position of the second contact is around the proximal end, while an extremely high resistance value is obtained when the contact position of the second contact is at the distal end even when the distance from the proximal end to the distal end is reduced. Thus, no electric energy that would cause arc discharge is accumulated at around any contact position.

In a contact contacting structure according to a second aspect, the intermediate contact body may have a truncated conical shape between the proximal end and the distal end in the separating direction with, about the axis of the movement path which is hollow; and the distal end of the truncated conical shape may be disposed at a position where energy accumulated between the intermediate contact body and the second contact by a voltage between the first contact and the second contact and a current that flows when the first contact and the second contact contact each other is less than an energy that causes arc discharge.

When the electric resistivity of the intermediate contact body is ρ, the radius at the proximal end of the conical shape is $b_2$, the radius of the movement path of the hollow, assuming the hollow to be cylindrical, is $b_1$, and the distance along the separating direction from the proximal end to an intersecting position where the inclined surface of the conical shape intersects the axis of the movement path is $a_2$, the resistance value of the intermediate contact body Rx at a position spaced apart from the proximal end by a distance x in the separating direction is expressed by $$R_x = \frac{\rho}{\pi} \cdot \frac{-a_2}{2b_2b_1}\left(\ln\left|\frac{-\frac{b_2}{a_2}x + b_2 - b_1}{-\frac{b_2}{a_2}x + b_2 + b_1}\right| - \ln\left|\frac{b_2 - b_1}{b_2 + b_1}\right|\right). \quad (1)$$

Thus, the resistance value gradually increases when the contact position of the second contact is around the proximal end of the intermediate contact body, rapidly increases as the contact position approaches the distal end of the conical shape, and becomes infinity at the position $a_1$ at which the movement path is opened where the distance x from the proximal end is $a_2(b_2-b_1)/b_2$.

By cutting the conical shape into a truncated conical distal end at the position of distance x where the energy accumulated between the intermediate contact body and the second contact is lower than the energy that causes arc discharge based on the voltage drop by the resistance value of the intermediate contact body R calculated according to expression (1), the development of arc discharge can be reliably prevented.

In a contact contacting structure according to a third aspect, the intermediate contact body may be formed from ferrite having higher electric resistivity than the first contact comprising a metal or an alloy.

The electric resistivity of ferrite is higher than the electric resistivity of metal or alloy typically used as a contact material, so that the gradient of the resistance value that is increased in accordance with the distance along the movement path can be increased.

In a contact contacting structure according to a fourth aspect, the second contact may include a proximal end contact portion comprising a metal or an alloy, and a protective contact portion disposed away from the proximal end contact portion in the separating direction and in a protruding manner around the second contact, the protective contact portion comprising ferrite; and the protective contact portion may contact the intermediate contact body at a position along the movement path where the intermediate contact body is exposed, and the proximal end contact portion may contact the first contact at a position along the movement path where the first contact is exposed.

Because the protective contact portion of the second contact that is formed of ferrite contacts the intermediate contact body formed of ferrite, the second contact does not become worn by contact with the intermediate contact body when moved along the movement path.

In a contact contacting structure according to a fifth aspect, the intermediate contact body may be formed from a ceramic resin having a higher electric resistivity than the first contact comprising a metal or an alloy.

Because the intermediate contact body is formed from a ceramic resin with higher electric resistivity than the first contact, the gradient of the resistance value that is increased in accordance with the distance along the movement path can be increased.

In a contact contacting structure according to a sixth aspect, the intermediate contact body may be formed from a conductive resin having a higher electric resistivity than the first contact comprising a metal or an alloy.

Because the intermediate contact body is formed from a conductive resin with higher electric resistivity than the first contact, the gradient of the resistance value that is increased in accordance with the distance along the movement path can be increased.

In a contact contacting structure according to a seventh aspect, the second contact may be a plug pin provided to a male connector; and the first contact may be a socket contact provided to a female connector configured to fittingly connected to the male connector and facing a plug insertion hole guiding insertion and removal of the plug pin.

Even if high electric energy is stored between the plug pin of the male connector and the socket contact of the female connector, no arc discharge is caused when inserting or removing the plug pin.

According to a first aspect of the invention, by simply providing the intermediate contact body with a shape such that the cross sectional area of the transverse section is gradually decreased in the separating direction in at least a partial section of the intermediate contact body, a setting can be made whereby the development of arc discharge can be prevented at any moment of the second contact separating from the first contact or the distal end of the intermediate contact body.

Particularly, the development of arc discharge can be reliably prevented even when the length of the intermediate contact body from the proximal end to the distal end thereof along the movement path is reduced, so that the size of the contact contacting structure as a whole is not increased.

According to a second aspect of the invention, the length of the intermediate contact body from the proximal end to the distal end thereof along the movement path can be minimized without causing arc discharge.

According to a third aspect of the invention, the length of the intermediate contact body along the movement path can be even more reduced, whereby the development of arc discharge can be prevented.

Compared with the intermediate contact body formed from a carbon-based resistor material, the contact surface that the second contact contacts is strong and does not become worn easily, and no sliding degradation is caused even if the second contact is repeatedly slidably contacted.

According to a fourth aspect of the invention, the second contact that contacts ferrite does not become worn even when ferrite is used for the intermediate contact body.

According to any one of a fifth or sixth aspect of the invention, the intermediate contact body is formed from a ceramic resin or conductive resin enabling injection molding, whereby even a complex shape such that the cross sectional area of the transverse section perpendicular to the movement path is gradually decreased in the separating direction can be easily molded.

According to a seventh aspect of the invention, no arc discharge is caused between the electric connectors comprising the male connector and the female connector for hot-line connection of electric power lines and the like for high voltage, high-current electric power transmission.

DESCRIPTION OF EMBODIMENTS

In the following, a contact contacting structure 1 according to an embodiment of the present disclosure will be described with reference to FIGS. 1 and 2. The contact contacting structure 1 is structured such that a plug pin 3, which is a second contact, is contacted with a socket contact 2, which is a first contact, to obtain electrical connection. In the present specification, the various portions will be described with reference to a contact direction in which the second contact 3 is moved toward the first contact 2, i.e., to the left in FIG. 1; a separating direction in which the second contact 3 is moved away from the first contact 2, i.e., to the right in FIG. 1; a proximal end side as being in the contact direction; and a distal end side as being in the separating direction. Throughout the embodiments described in the present specification, configurations that are similar to or that act similarly to the contact contacting structure 1 will be designated with similar numerals and their detailed description will be omitted.

The socket contact 2 is fitted to a connector socket providing a female connector connected to an electric power line terminal. The plug pin 3 is fitted to a connector plug providing a male connector connected to a load that operates by being supplied with electric power via the electric power line. For example, via the socket contact 2 and the plug pin 3 contacted by fittingly connecting the connector plug to the connector socket, 400 V and 2 A, or 800 W of electric power is supplied via the electric power line to the load.

Figure 1:
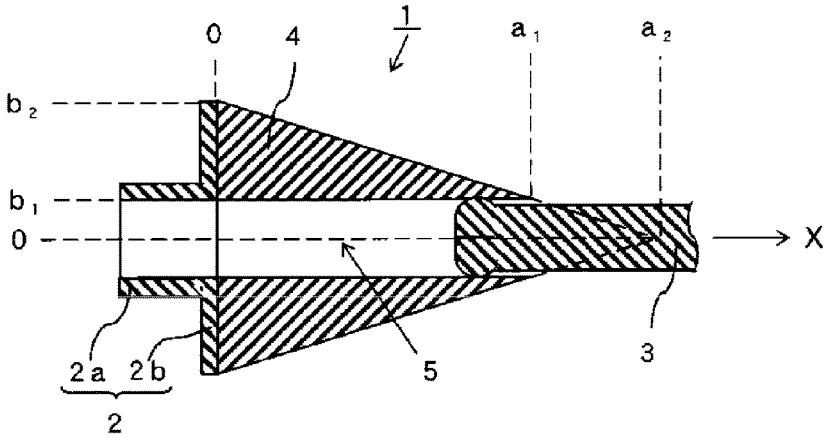
FIG. 1 is a longitudinal cross sectional view of a contact contacting structure 1 according to an embodiment of the present disclosure.

As illustrated in FIG. 1, continuously with the connector socket, there is disposed an intermediate contact body 4 with a conical shape in the separating direction of the socket contact 2. The socket contact 2 and the intermediate contact body 4 are formed around the same central axis, with a plug insertion hole 5 providing communication along the central axis (X-axis). The plug insertion hole 5 is formed along an X-direction along the contact direction and the separating direction, with an inner diameter $2b_1$ being substantially the same as or slightly smaller than an outer diameter of the plug pin 3 being inserted into or pulled out of the plug insertion hole 5. Accordingly, the plug pin 3 is guided to move in the contact direction and the separating direction along the movement path of the plug insertion hole 5 while slidably contacting inner wall surfaces of the plug insertion hole 5 in which the socket contact 2 and the intermediate contact body 4 are continuous.

The socket contact 2 includes a cylindrical contact portion 2*a* and a ring connection portion 2*b* orthogonally intersecting the cylindrical contact portion 2*a* at the distal end of the cylindrical contact portion 2*a*. The cylindrical contact portion 2*a* and the ring connection portion 2*b* may be integrally formed from a copper alloy, such as phosphor bronze or brass. The ring connection portion 2*b* has an outer diameter $2b_2$ which is equal to the outer diameter at the proximal end of the conical intermediate contact body 4. A distal end surface of the ring connection portion 2*b* is securely attached to the opposite, proximal end surface of the intermediate contact body 4 of the same shape, with conductive adhesive and the like. Thus, the socket contact 2 and the proximal end of the intermediate contact body 4 are electrically connected.

The intermediate contact body 4 has a conical shape having a proximal end outer diameter of $2b_2$ and a separating direction (X-direction) height of $a_2$, with the plug insertion hole 5 having the inner diameter of $2b_1$ being formed along the central axis thereof. The intermediate contact body 4 is formed from ferrite having sufficiently higher electric resistivity ρ than the socket contact 2 formed from copper alloy. Ferrite is a sintered material comprising conductive particles of iron, magnesium, zinc and the like being bound by glass. By adjusting the compounding ratio of the conductive particles and glass, a desired electric resistivity ρ can be obtained in the width on the order of 1 Ωcm to 800 Ωcm. Accordingly, as will be described later, by varying the electric resistivity ρ of ferrite, the resistance value R of the intermediate contact body 4 that increases in accordance with the distance x from the proximal end (x=0) in the X-direction can be adjusted as desired in a range of one to 800 times. Further, by using the sintered material of ferrite, wear of the intermediate contact body 4 as the plug pin 3 is slidably contacted therewith can be prevented, so that sliding degradation due to repeated sliding contact can be prevented.

With regard to the contact contacting structure 1 configured as described above, the resistance value between the socket contact 2 and the plug pin 3 that changes in accordance with the contact position (x) of the plug pin 3 will be described. Typically, the metal or alloy used for forming the contacts 2 and 3 has the electric resistivity ρ of several μΩcm. In contrast, as described above, ferrite has the electric resistivity ρ that is higher by a factor of $10^6$ to $10^8$. Thus, the resistance values of the socket contact 2 and the plug pin 3, both comprising conductive material, are very small compared with the resistance value R of the intermediate contact body 4. In addition, the connection resistance between the socket contact 2 and the intermediate contact body 4, and the contact resistance between the intermediate contact body 4 and the plug pin 3 are substantially constant regardless of the contact position (x) of the plug pin 3. Accordingly, in the present specification, these resistance values will be disregarded, and the resistance value R of the intermediate contact body 4 will be regarded as being the resistance value between the socket contact 2 and the plug pin 3 for description purposes.

The resistance value R of the intermediate contact body 4 between the socket contact 2 and the plug pin 3 is proportional to the distance x in the X-direction along the movement path of the plug pin 3 from the proximal end (x=0) connected to the socket contact 2 to a contact position xp of the plug pin 3, and is inversely proportional to the cross sectional area S of a transverse section perpendicular to the X-direction, such that, when the intermediate contact body 4 has the electric resistivity ρ, $$R=x/S.$$

The intermediate contact body 4 has the conical shape with the plug insertion hole 5 formed about the X-axis, which is the central axis of the cone, the cross sectional area S of the transverse section perpendicular to the X-direction varies depending on the distance x in the X-direction. The transverse sectional area Sx at a position spaced apart from the proximal end by the distance x is expressed by $$Sx=\pi\cdot(b_2-b_2\cdot x/a_2)^2-\pi\cdot b_1^2$$

where $b_2$ is the radius at the proximal end, $b_1$ is the radius of the plug insertion hole 5, and $a_2$ is the height of the conical shape from the proximal end (X-direction length), as illustrated in FIG. 1.

Accordingly, the resistance value ΔR of the intermediate contact body 4 having an infinitesimal width Δx at that position is expressed by $$\Delta R=\rho\cdot\Delta x/Sx=\rho\cdot\Delta x/\pi\cdot\{(b_2-b_2\cdot x/a_2)^2-b_1^2\}.$$

When the gradient $-b_2/a_2$ of the cone is k, the resistance value Rx of the intermediate contact body 4 from the proximal end (x=0) to the contact position xp of the plug pin 3 at a distance x is expressed by $$R_x=\frac{\rho}{\pi}\int_o^x\left(\frac{1}{(kx+b_2)^2-b_1^2}\right)dx. \tag{2}$$

Thus, integrating the expression yields $$R_x=\frac{\rho}{\pi}\cdot\frac{-a_2}{2b_2b_1}\left(\ln\left|\frac{-\frac{b_2}{a_2}x+b_2-b_1}{-\frac{b_2}{a_2}x+b_2+b_1}\right|-\ln\left|\frac{b_2-b_1}{b_2+b_1}\right|\right). \tag{1}$$

From expression (1), when the contact position xp of the plug pin 3 is at the proximal end (x=0) and connected to the socket contact 2, since x is 0 (hereafter, positions at distances $a_1$, $a_2$, and $a_3$ from the proximal end along the X-direction will be referred to as $a_1$, $a_2$, and $a_3$), the resistance value Rx of the intermediate contact body 4 is 0. The resistance value gradually increases along the separating direction away from the proximal end, and the resistance value Rx becomes infinite at the distal end a1 of the intermediate contact body 4 where the distance x from the proximal end is $a_2(b_2-b_1)/b_2$.

Figure 2:
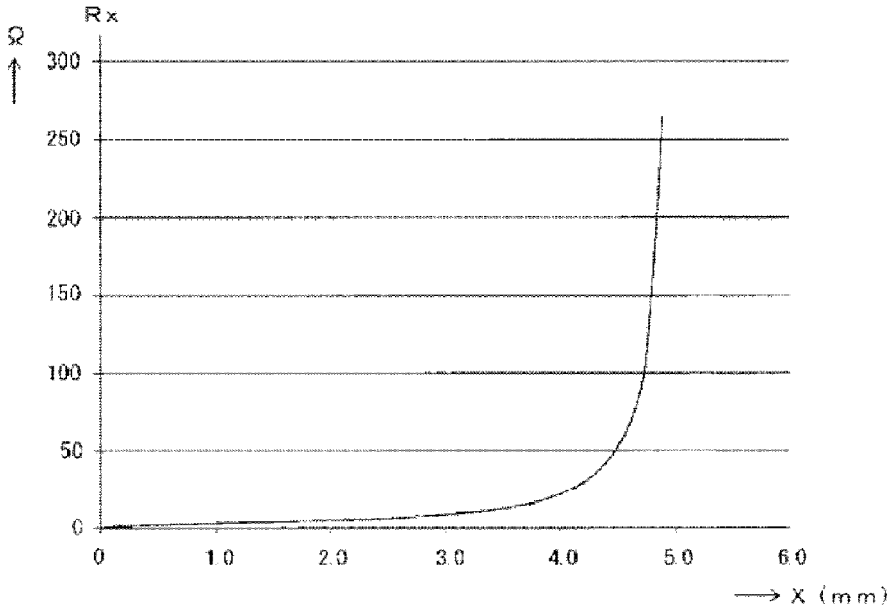
FIG. 2 is a graph indicating a relationship between the contact position (x) of a second contact 3 and the resistance value Rx with an intermediate contact body 4.

FIG. 2 is a graph showing the result of calculation of the relationship between the distance x from the proximal end and the resistance R of the intermediate contact body 4 from the proximal end to the distance x using expression (1), where the intermediate contact body 4 is formed from ferrite having the electric resistivity ρ of 0.03 Ωm, the conical shape has the radius $b_2$ of 3 mm at the proximal end thereof, and the conical shape has the height (length in the X-direction) $a_2$ of 5 mm. For ease of computation, it is assumed that the plug insertion hole 5 is not formed so that the radius $b_1$ is 0.

As illustrated in the graph, as long as the plug pin 3 is moved by approximately 4 mm in the separating direction from the proximal end at which the contact position xp of the plug pin is connected to the socket contact 2, the resistance R of the intermediate contact body 4 is not more than 22Ω. Thus, even if large electric energy is accumulated between the plug pin 3 and the socket contact 2, no arc discharge is caused between the plug pin 3 and the socket contact 2 because they are electrically connected via the low-resistance intermediate contact body 4. As the contact position xp of the plug pin 3 approaches the distal end of the intermediate contact body 4, the resistance Rx of the intermediate contact body 4 rapidly increases. For example, at the contact position xp with a distance x of 4.9 mm from the proximal end, the resistance is 260Ω. At the distal end of the intermediate contact body 4 at which the intermediate contact body 4 and the plug pin 3 are separated (distance x from the proximal end is 5 mm), the resistance theoretically becomes infinite. Accordingly, at the moment of electrical disconnection of the plug pin 3 and the socket contact 2, there is no electric energy that would cause arc discharge between the distal end of the intermediate contact body 4 and the plug pin 3 because of the presence of the high resistance-value intermediate contact body 4, which greatly decreases the voltage between the distal end of the intermediate contact body 4 and the plug pin 3.

According to the contact contacting structure 1 of the first embodiment, the resistance R of the intermediate contact body 4 can be changed from several Ω to near infinity by simply using the short intermediate contact body 4 with the length along the movement path 5 on the order of 5 mm, for example. Particularly, as illustrated in FIG. 2, until the plug pin 3 and the socket contact 2 are separated by approximately 4 mm, the interposed intermediate contact body 4 exhibits low resistance values, so that no arc discharge is caused between the plug pin 3 and the socket contact 2 that approach each other with the intermediate contact body 4 providing an insulator. Meanwhile, after the contact position Xp of the plug pin 3 has left the proximal end by 4 mm and moves by a mere 1 mm to the distal end of the intermediate contact body 4, the resistance Rx of the intermediate contact body 4 increases to infinity. Accordingly, no arc discharge is caused between the plug pin 3 and the distal end of the intermediate contact body 4 even at the moment of separation thereof.

Thus, when the plug pin 3 is pulled out of the distal end $a_1$ of the intermediate contact body 4, i.e., when the plug pin 3 and the socket contact 2 are electrically disconnected, the resistance Rx of the intermediate contact body 4 increases to infinity as the plug pin 3 is moved along the separating direction, and then the intermediate contact body 4 and the plug pin 3 are separated and insulated. Accordingly, the resistance value between the plug pin 3 and the socket contact 2 is continuously varied from several Ω to infinity, so that there is no rapid current change, no electromagnetic noise is generated between the contacts 2 and 3, and no induction voltage is caused even when the connected circuit includes inductance.

Figure 3:
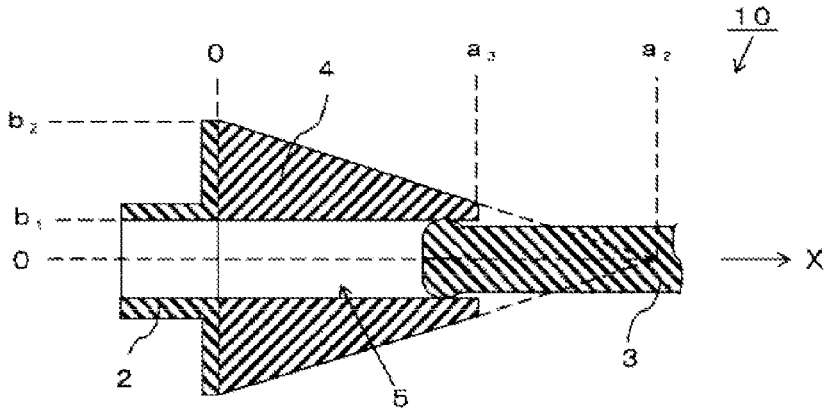
FIG. 3 is a longitudinal cross sectional view of a contact contacting structure 10 according to a second embodiment.

In the contact contacting structure 1, the resistance R of the intermediate contact body 4 is increased to infinity by converging the cross sectional area of the transverse section perpendicular to the direction (X-direction) to zero at the distal end $a_1$ of the intermediate contact body 4 along the movement path. Meanwhile, because the intermediate contact body 4 has an acute angle at the opening of the plug insertion hole 5 with the resultant decrease in strength, the plug pin 3 as it is inserted into the plug insertion hole 5 may abut on the intermediate contact body and damage the same. FIG. 3 illustrates a contact contacting structure 10 according to a second embodiment that solves the problem of the contact contacting structure 1 by cutting the distal end portion of the conical intermediate contact body 4 into a truncated conical shape at the position where no arc discharge is caused.

As described above, when the connector plug is connected to the connector socket and 400 V and 2 A or 800 W of electric power is supplied to the load via the electric power line, 400 V and 2 A of electric energy is generated between the socket contact 2 and the plug pin 3 at the moment of their disconnection. When the upper limit of electric energy that would not cause arc discharge between the distal end of the intermediate contact body 4 from which the plug pin 3 is separated and the plug pin 3 is 15 V and 2 A, for example, the development of arc discharge can be prevented by making the resistance value Rx of the intermediate contact body 4 at the distal end of the intermediate contact body 4 (400−15)V/2 A=192.5Ω or more.

When the side surface of the intermediate contact body 4 is a conical inclined surface as in the contact contacting structure 1, the relationship between the distance x and the resistance value Rx of the intermediate contact body 4 at the contact position Xp spaced apart from the proximal end by a distance x is obtained by $$R_x = \frac{\rho}{\pi} \cdot \frac{-a_2}{2b_2b_1}\left(\ln\left|\frac{-\frac{b_2}{a_2}x + b_2 - b_1}{-\frac{b_2}{a_2}x + b_2 + b_1}\right| - \ln\left|\frac{b_2 - b_1}{b_2 + b_1}\right|\right). \quad (1)$$

Thus, the development of arc discharge can be prevented by determining the distance x from the proximal end to the distal end of the intermediate contact body 4 for the resistance value Rx of expression (1) of 192.5Ω, and setting the position of the distance x as the position $a_3$ of the distal end of the truncated-conical intermediate contact body 4.

The position $a_3$ of the distal end of the truncated conical shape of the intermediate contact body 4 can be adjusted as desired by varying one or more of the variables in expression (1), i.e., the electric resistivity ρ, the radius $b_2$ of the proximal end, the radius $b_1$ of the plug insertion hole 5, and the height $a_2$ of the conical shape from the proximal end (length in the X-direction).

Figure 4:
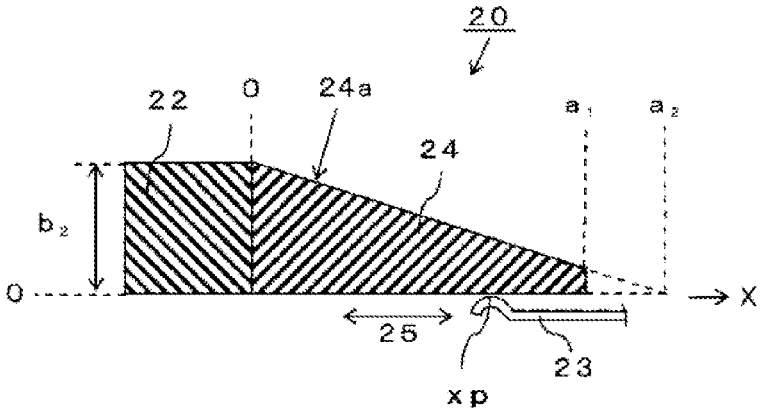
FIG. 4 is a longitudinal cross sectional view of a contact contacting structure 20 according to a third embodiment.

FIG. 4 is a longitudinal cross sectional view of a contact contacting structure 20 according to a third embodiment in which a plane 24*a* of a cubic intermediate contact body 24 is inclined in the separating direction toward a movement path 25 on the bottom surface, whereby the transverse sectional area of the intermediate contact body 24 perpendicular to the movement path 25 is gradually decreased in the separating direction. In the contact contacting structure 20, a first contact 22 has a cuboidal shape, and a second contact 23 is formed of a plate-spring piece biased toward the bottom surface of the first contact 22.

The bottom surfaces of the first contact 22 and the intermediate contact body 24 integrally electrically connected therewith in the separating direction are continuous in the same plane, so that the second contact 23 can slide in the contact direction and the separating direction while moving along the bottom surfaces in an elastically contacting manner. Namely, the path along the contact direction and the separating direction on the continuous bottom surfaces of the first contact 22 and the intermediate contact body 24 provides a movement path 25 for the second contact 23.

As illustrated in FIG. 4, the cross sectional area Sx of the transverse section perpendicular to the X-direction at a position spaced apart from the proximal end of the intermediate contact body 24 by the distance x is expressed by $$Sx=L\cdot(b_2-b_2\cdot x/a_2)$$

where $b_2$ is the height of the proximal end, $a_2$ is the length from the proximal end to position at which the inclined surface 24*a* and the movement path 25 intersect each other, and L is the depth, not shown, in the direction perpendicular to the sheet of the drawing.

Accordingly, the resistance value ΔR of the intermediate contact body 4 in an infinitesimal width Δx at that position is expressed by $$\Delta R=\rho\cdot\Delta x/Sx=\rho\cdot\Delta x/L\cdot(b_2-b_2\cdot x/a_2).$$

When the gradient $-b_2/a_2$ of the cone is k, the resistance value Rx of the intermediate contact body 4 from the proximal end (x=0) to the contact position xp of the second contact 23 at a distance x is expressed by $$R_x=\frac{\rho}{L}\int_o^x\frac{1}{kx+b_2}\,dx. \tag{3}$$

Accordingly, integrating the expression yields $$R_x=\frac{\rho\cdot a_2}{L\cdot b_2}\left(\ln\left|\frac{a_2}{a_2-x}\right|\right). \tag{4}$$

From expression (4), at the proximal end (x=0) where the contact position xp of the second contact 23 is connected to the first contact 22, x is 0, so that the resistance value Rx of the intermediate contact body 4 is 0. The resistance value increases more gradually than in the first or the second embodiment along the separating direction from the proximal end, and the resistance value Rx is at a maximum at the distal end a1 of the intermediate contact body 24. The minimum length of the intermediate contact body 24 along the movement path 25 may also be determined by substituting into expression (4) the resistance value Rx of the intermediate contact body 24 as a threshold value such that no arc discharge is caused at the distal end a1 of the intermediate contact body 24.

Figure 5:
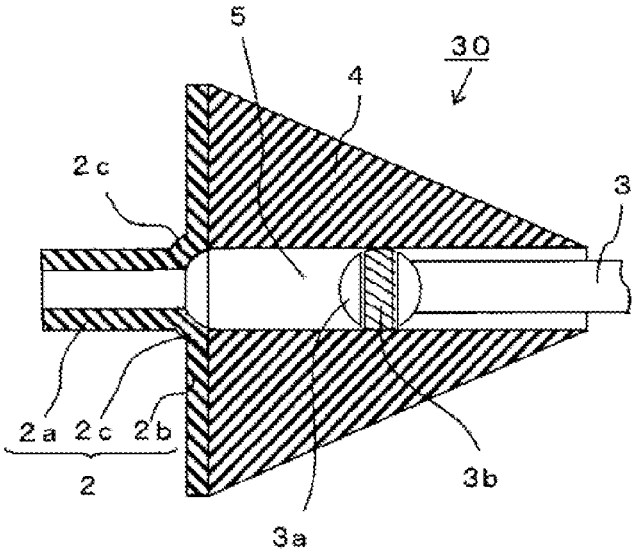
FIG. 5 is a longitudinal cross sectional view of a contact contacting structure 30 according to a fourth embodiment.
Figure 6:
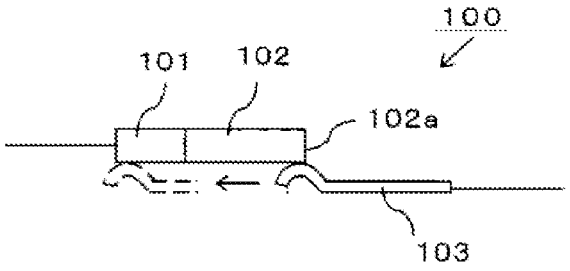
(RELATED ART) FIG. 6
FIG. 6 is a lateral view of a typical contact contacting structure 100.
Figure 7A:
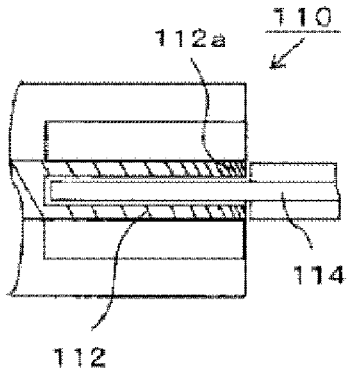
(RELATED ART) FIG. 7A
FIG. 7A is a longitudinal cross sectional view of a typical contact contacting structure 110 in a state where a counterpart contact 114 is being completely inserted.
Figure 7B:
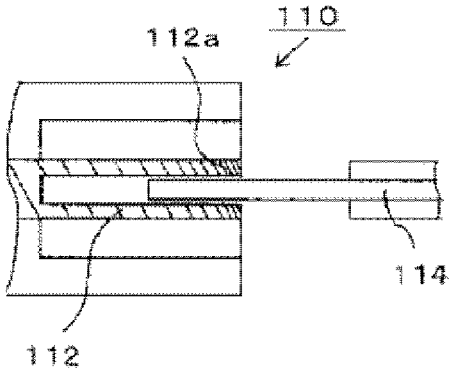
(RELATED ART) FIG. 7B
FIG. 7B is a longitudinal cross sectional view of the typical contact contacting structure 110 in a state where the counterpart contact 114 has been pulled along the movement path.
Figure 8:
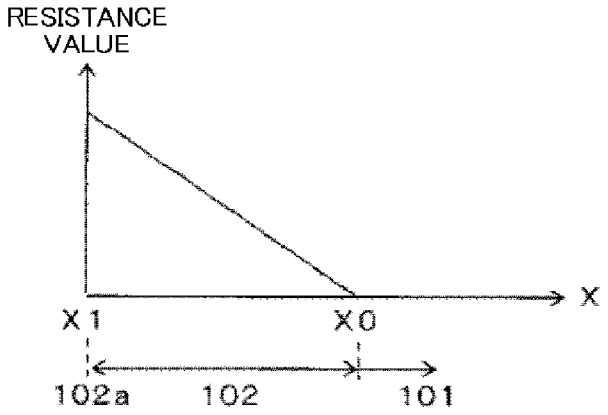
( RELATED ART ) FIG. 8
FIG. 8 is a graph indicating an amount of movement x of the contact 103 of the counterpart connector of the contact contacting structure 100 and changes in the resistance value of a resistor 102.

In the foregoing embodiments, in order to prevent wear due to the sliding contact of the second contact 3 or 23, the intermediate contact body 4 or 24 is formed from ferrite which is a sintered material. As a result, the second contact 3 or 23 that slidably contact the ferrite may become worn and degraded. FIG. 5 is a cross sectional view of a contact contacting structure 30 according to a fourth embodiment for solving the problem. As illustrated, compared with the contact contacting structure 10 according to the second embodiment, the plug pin 3 as the second contact includes a contact body comprising copper alloy with a spherical portion 3*a* disposed on the proximal end side. A ferrite ring contact portion 3*b* that internally contacts the plug insertion hole 5 is wound around the circumference of the spherical portion 3*a* disposed inside the plug insertion hole 5. The socket contact 2 includes a link portion 2*c* between the cylindrical contact portion 2*a* and the ring connection portion 2*b* that has a recess-curved surface configured to abut and contact the spherical surface of the spherical portion 3*a* exposed on the proximal end side of the plug pin 3.

Accordingly, as long as the plug pin 3 slidably contacts the intermediate contact body 4 in the plug insertion hole 5, the ferrite ring contact portion 3*b* makes contact. When the plug pin 3 is inserted into the plug insertion hole 5 in the contact direction until the plug pin abuts the socket contact 2, the spherical portion 3*a* of the contact body comprising copper alloy contacts the link portion 2*c* of the socket contact 2. Thus, when the plug pin 3 and the socket contact 2 are contacted, there is no interposed ferrite having the relatively high electric resistivity ρ, whereby the plug pin 3 and the socket contact 2 are electrically connected without electric power loss. Until the plug pin 3 contacts the socket contact 2, the ferrite intermediate contact body 4 and the ring contact portion 3*b* are in slidable contact with each other, so that neither become worn.

The foregoing embodiments have been described with reference to the shape of the intermediate contact body 4 or 24 such that the cross sectional area of the transverse section of the intermediate contact body 4 or 24 perpendicular to the movement paths 5 and 25 gradually decreases continuously from the proximal end to the distal end in the separating direction. However, the shape may be such that the cross sectional area perpendicular to the movement path is gradually decreased in at least a partial section between the proximal end to the distal end. Nevertheless, the shape of the intermediate contact body 4 or 24 along the movement path needs to be such that no arc discharge is caused by a voltage drop by the resistance value Rx of the intermediate contact body 4 or 24 from the proximal end to the position at which the transverse sectional area is at a minimum, at the contact position xp toward the distal end side with respect to the minimizing position.

When the intermediate contact body 4 or 24 is formed from ferrite which is a sintered material, it may be difficult to perform processing for obtaining the shape such that the cross sectional area S of the transverse section perpendicular to the movement path is gradually decreased in the separating direction. In this case, the desired intermediate contact body 4 or 24 may be formed using ceramic resin as long as it is conductive material having an electric resistivity ρ such that the present disclosure can be implemented. The ceramic resin herein refers to a mixture of thermoplastic resin, such as polyphenylene sulfide (PPS), and conductive ceramic granular material, such as titanium boride, at a predetermined ratio, or a mixture of thermoplastic resin, insulating ceramic granular material, and an arbitrary conductive filler at a predetermined ratio, that can ensure sufficient moldability during injection molding of thermoplastic resin and that has a composition such that the resultant molded product has electrical conductivity. Such ceramic resin may be obtained by, for example, lowering the compounding ratio of titanium boride (TiB2) as needed in the first comparative example in JP-A-2003-34751. The composition of the ceramic resin is not limited to thermoplastic resin and conductive ceramic granular material, and fibers such as glass fibers and other additives may be added as needed.

Similarly, the intermediate contact body 4 or 24 of a complex shape may be molded by using a different molding material, such as a low-resistance conductive resin, as long as it is a conductive material having an electric resistivity ρ such that the present disclosure can be implemented. The electric resistivity ρ such that the present disclosure can be implemented refers to the electric resistivity ρ in a range such that the development of arc discharge around the proximal end of the intermediate contact body and the distal end thereof can be reliably prevented with a size of the intermediate contact body that can be disposed at the contact contacting structure portion and with the resistance value Rx from the proximal end to the distal end that is calculated according to the electric resistivity ρ of the intermediate contact body.

While the embodiments have been described with reference to the contact contacting structure provided in an electric connector comprising a connector plug and a connector socket, an embodiment may be applied to a contact contacting structure other than that of an electric connector, such as to that of a relay or a switch, as long as the structure comprises a first contact and a second contact that are moved in a contact direction and a separating direction along a constant movement path so as to connect or disconnect the first contact.

The present disclosure may be suitably applied to a contact contacting structure for hot-line connection of contacts that could potentially cause arc discharge.

The invention claimed is:

1. A contact contacting structure comprising:

a first contact;

a second contact; and an intermediate contact body electrically connected to the first contact, including a conductive material having a higher electric resistivity than the first contact, and continuously exposed along a movement path of the second contact for connection to or disconnection from the first contact, wherein the second contact is configured to separate from the intermediate contact body after contacting the first contact and then the intermediate contact body when moved from the first contact in a separating direction along the movement path, and the intermediate contact body has a shape such that a cross sectional area of a transverse section perpendicular to the movement path gradually decreases in the separating direction at least in a section between a proximal end electrically connected to the first contact and a distal end in the separating direction.

2. The contact contacting structure according to claim 1, wherein the intermediate contact body has a truncated conical shape between the proximal end and the distal end in the separating direction with, about the axis of the movement path which is hollow, and the distal end of the truncated conical shape is disposed at a position where energy accumulated between the intermediate contact body and the second contact by a voltage between the first contact and the second contact and a current that flows when the first contact and the second contact contact each other is less than an energy that causes arc discharge.

3. The contact contacting structure according to claim 1, wherein the intermediate contact body is formed from ferrite having higher electric resistivity than the first contact comprising a metal or an alloy.

4. The contact contacting structure according to claim 3, wherein the second contact includes a proximal end contact portion comprising a metal or an alloy, and a protective contact portion disposed away from the proximal end contact portion in the separating direction and in a protruding manner around the second contact, the protective contact portion comprising ferrite, and the protective contact portion contacts the intermediate contact body at a position along the movement path where the intermediate contact body is exposed, and the proximal end contact portion contacts the first contact at a position along the movement path where the first contact is exposed.

5. The contact contacting structure according to claim 1, wherein the intermediate contact body is formed from a ceramic resin having a higher electric resistivity than the first contact comprising a metal or an alloy.

6. The contact contacting structure according to claim 5, wherein the ceramic resin is a mixture of thermoplastic resin and conductive ceramic granular material.

7. The contact contacting structure according to claim 5, wherein the ceramic resin is a mixture of thermoplastic resin, insulating ceramic granular material, and a conductive filler.

8. The contact contacting structure according to claim 1, wherein the intermediate contact body is formed from a conductive resin having a higher electric resistivity than the first contact comprising a metal or an alloy.

9. The contact contacting structure according to claim 1, wherein the second contact is a plug pin provided to a male connector, and the first contact is a socket contact provided to a female connector configured to fittingly connect to the male connector and facing a plug insertion hole guiding insertion and removal of the plug pin.

10. The contact contacting structure according to claim 1, wherein the electric resistivity of the intermediate contact body is on the order of 1 Ωcm to 800 Ωcm.

11. The contact contacting structure according to claim 10, wherein the electric resistivity of the first contact and the electric resistivity of the second contact are several μΩcm.

* * * * *